US008497810B2

(12) United States Patent
Kits van Heyningen et al.

(10) Patent No.: US 8,497,810 B2
(45) Date of Patent: Jul. 30, 2013

(54) MULTI-BAND ANTENNA SYSTEM FOR SATELLITE COMMUNICATIONS

(75) Inventors: Martin Arend Kits van Heyningen, Newport, RI (US); Thomas D. Monte, Homer Glen, IL (US); Robert Balog, Wrenthem, MA (US)

(73) Assignee: KVH Industries, Inc., Middletown, RI (US)

( * ) Notice: Subject to any disclaimer, the term of this patent is extended or adjusted under 35 U.S.C. 154(b) by 805 days.

(21) Appl. No.: 12/725,712

(22) Filed: Mar. 17, 2010

(65) Prior Publication Data

US 2010/0238082 A1 Sep. 23, 2010

Related U.S. Application Data

(60) Provisional application No. 61/161,234, filed on Mar. 18, 2009.

(51) Int. Cl.
*H01Q 13/00* (2006.01)
*H01Q 3/12* (2006.01)

(52) U.S. Cl.
USPC ..... 343/781 CA; 343/781 P; 343/761

(58) Field of Classification Search
USPC ..... 343/781 CA, 781 P, 761, 762, 763, 343/779
See application file for complete search history.

(56) References Cited

U.S. PATENT DOCUMENTS

| | | | | |
|---|---|---|---|---|
| 3,305,870 | A | 2/1967 | Webb | |
| 4,122,446 | A | 10/1978 | Hansen | |
| 5,373,302 | A | 12/1994 | Wu | |
| 5,835,057 | A | 11/1998 | Kits van Heyningen | |
| 5,949,387 | A | 9/1999 | Wu et al. | |
| 6,208,316 | B1 | 3/2001 | Cahill | |
| 6,680,711 | B2 * | 1/2004 | Desargant et al. | 343/781 CA |
| 7,224,320 | B2 | 5/2007 | Cook | |
| 7,443,355 | B2 | 10/2008 | Griffiths | |
| 8,009,116 | B2 * | 8/2011 | Peichl et al. | 343/757 |

* cited by examiner

*Primary Examiner* — Robert Karacsony
*Assistant Examiner* — Hasan Islam
(74) *Attorney, Agent, or Firm* — Lowenstein Sandler LLP

(57) ABSTRACT

The present invention provides an improved antenna system on moving platform that is in communication with multiple satellites for simultaneous reception and transmission of RF energy at multiple frequencies. The antenna is implemented as a multi-beam, multi-band antenna having a main reflector with multiple feed horns and a sub-reflector having a reflective surface defining an image focus for a Ka band frequency signal and a prime focus for a Ku band frequency signal.

15 Claims, 9 Drawing Sheets

Measured Ku-band Transmission Loss

Measured Ka-band Transmission Loss (Leakage Level)

MULTI-BAND ANTENNA SYSTEM FOR SATELLITE COMMUNICATIONS

CROSS REFERENCES

This patent application claims the benefit of U.S. Provisional Application Serial No. 61/161,234 filed Mar. 18, 2009, the contents of which are incorporated by reference herein.

FIELD OF THE INVENTION

The present invention is generally related to the field of satellite communications and antenna systems, and is more specifically directed to multi-band antenna systems that allow simultaneous reception of RF energy from multiple satellites positioned in several orbital slots broadcasting at multiple frequencies.

BACKGROUND OF THE INVENTION

An increasing number of applications are requiring systems that employ a single antenna designed to receive from and/or transmit RF energy to multiple satellites positioned in several orbital slots broadcasting at multiple frequencies. In cases where the satellites are very close to each other, it creates a challenge for reflector antenna systems often resulting in compromised performance and/or increased cost and complexity. On a given reflector system, a feed horn or a radiating element is needed for each satellite to receive and/or transmit frequencies.

A typical mobile satellite antenna has a stationary base and a satellite-following rotatable assembly mounted on the base for two- or three-axis rotation with respect to the base. The assembly includes a primary reflector, a secondary shaped sub-reflector, and a low-noise block down-converter, and it may also include gyroscopes for providing sensor inputs to the rotatable assembly's orientation-control system. A typical configuration of this satellite antenna mounting approach is disclosed in U.S. Pat. No. 7,443,355.

U.S. Pat. No. 5,835,057 discloses a mobile satellite communication system including a dual-frequency antenna assembly. This system is configured to allow for the Ku band signals containing video and imagery data to be received by the antenna device and the L band signals containing voice/facsimile to be both received and transmitted by the antenna device on a moving vehicle.

U.S. Pat. No. 7,224,320 discloses an antenna device capable of reception from (and/or transmission to) at least three satellites of three separate RF signals utilizing a basic offset reflector on a stationary platform. This device allows for digital broadcast signals from digital video broadcast satellites in Ka, Ku and Ka frequency bands on the stationary platform.

U.S. Pat. No. 5,373,302 discloses an antenna device capable of transmission of three or more separate RF signals using a primary reflector and a frequency selective surface sub-reflector on a stationary platform. The device fails to disclose providing the antenna device on a moving platform and also fails to disclose any time of movement of the reflector including its components to track separate frequency signals.

Thus there is a need to provide an improved antenna system that allows for simultaneous reception of at least three or more television signals including at least two or more high definition television signals (HDTV) (as opposed to the digital signals of the prior art) on a moving platform.

SUMMARY OF THE INVENTION

One of the objectives of the present invention is to design an antenna that is capable of receiving or transmitting simultaneously at least three separate RF signals with orthogonal, linear or circular polarization. This is accomplished by providing a mobile antenna system in communication with multiple satellites for use in a moving platform. The system includes a primary reflector shaped and positioned to receive and reflect preferably at least one Ku band signal and preferably at least two Ka band signals of different angles at a focal region located on the primary reflector. The primary reflector has at least one opening for accommodating at least two feed horns to receive the at least two Ka band signals. The system also includes a sub-reflector shaped and positioned to face the focal region to receive and reflect the at least two Ka band signals that the primary reflector has directed to the focal region. The sub-reflector also functions to receive at least one Ku signal reflected by the primary reflector. The system further includes a motor driven mechanism positioned around the feed horns which function to rotate the two feed horns about a center axis of the primary reflector.

In one embodiment, the sub-reflector has a Frequency selective surface (FSS) which allows Ku frequencies to pass directly through the sub-reflector while the Ka band frequencies are reflected back into a primary reflector.

In another embodiment the sub-reflector has a reflecting surface with an opening which allows Ku frequencies to pass through the sub-reflector via the opening while the Ka band frequencies are reflected back into a primary reflector.

DETAILED DESCRIPTION OF THE INVENTION

Figure 1A:
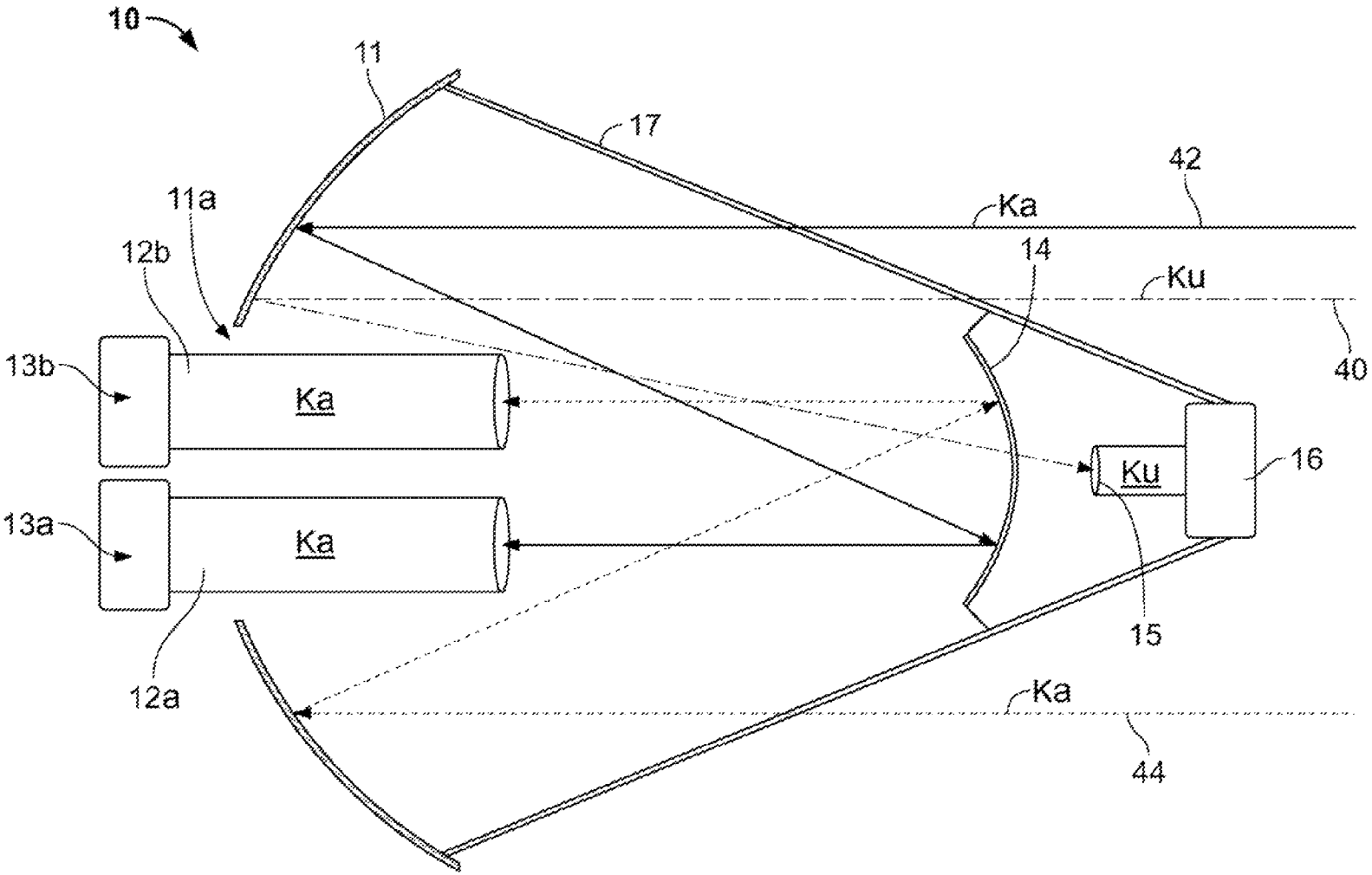
FIG. 1A depicts a schematic view of an antenna system in accordance with an embodiment of the present invention.
Figure 1B:
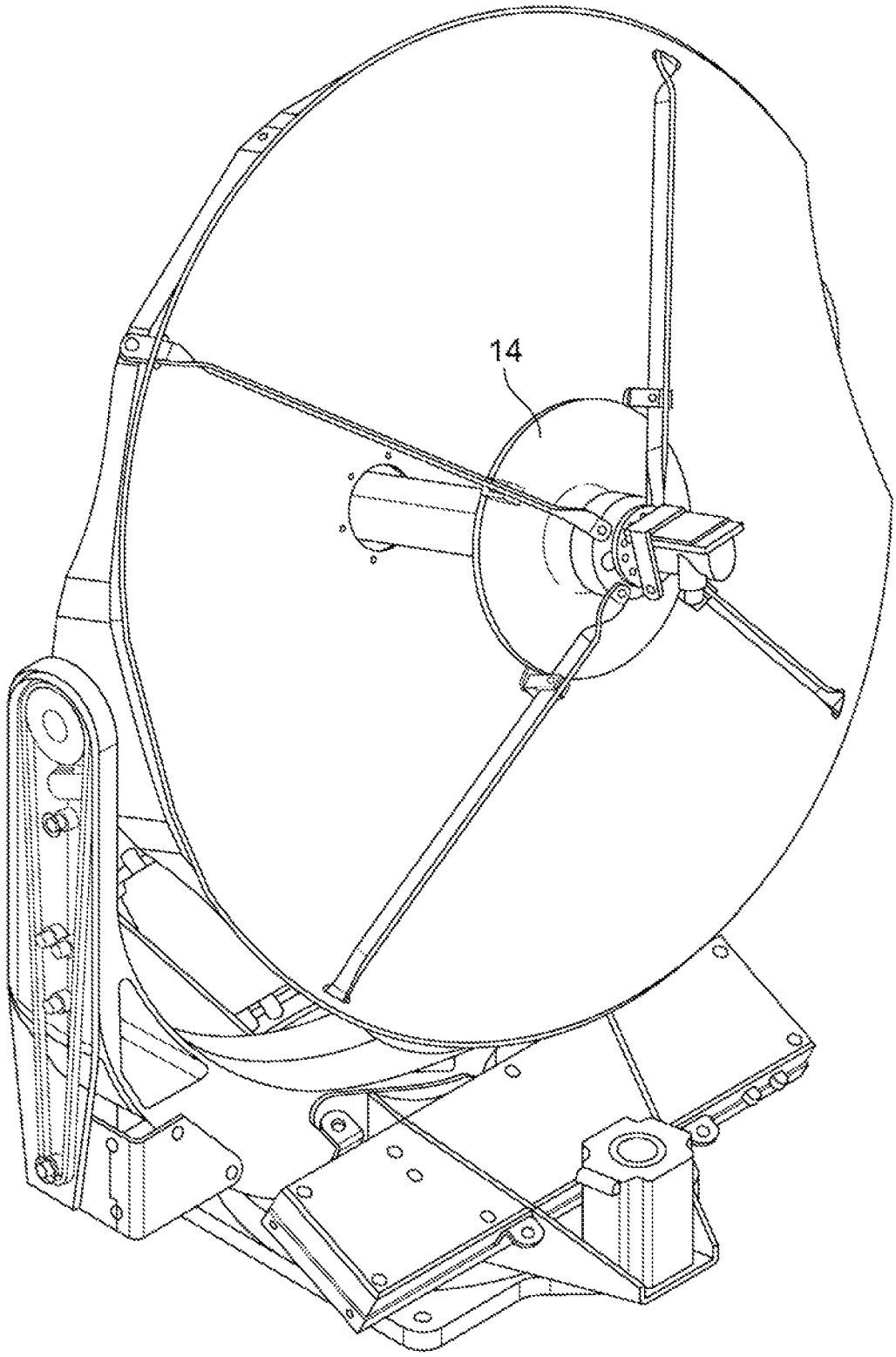
FIG. 1B, FIG. 1C and FIG. 1D illustrate a front, top and rear view respectively of the antenna of FIG. 1A in accordance with a preferred embodiment of the present invention.
Figure 1C:
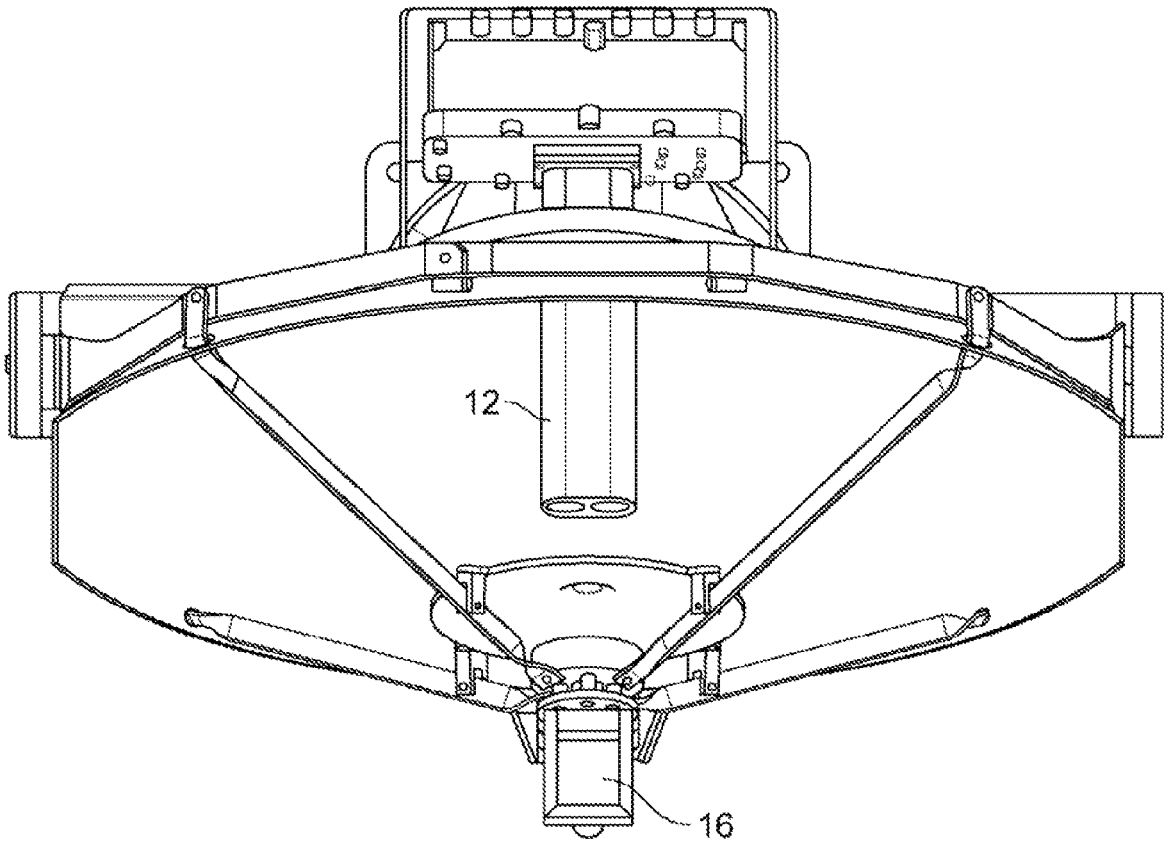
Figure 1D:
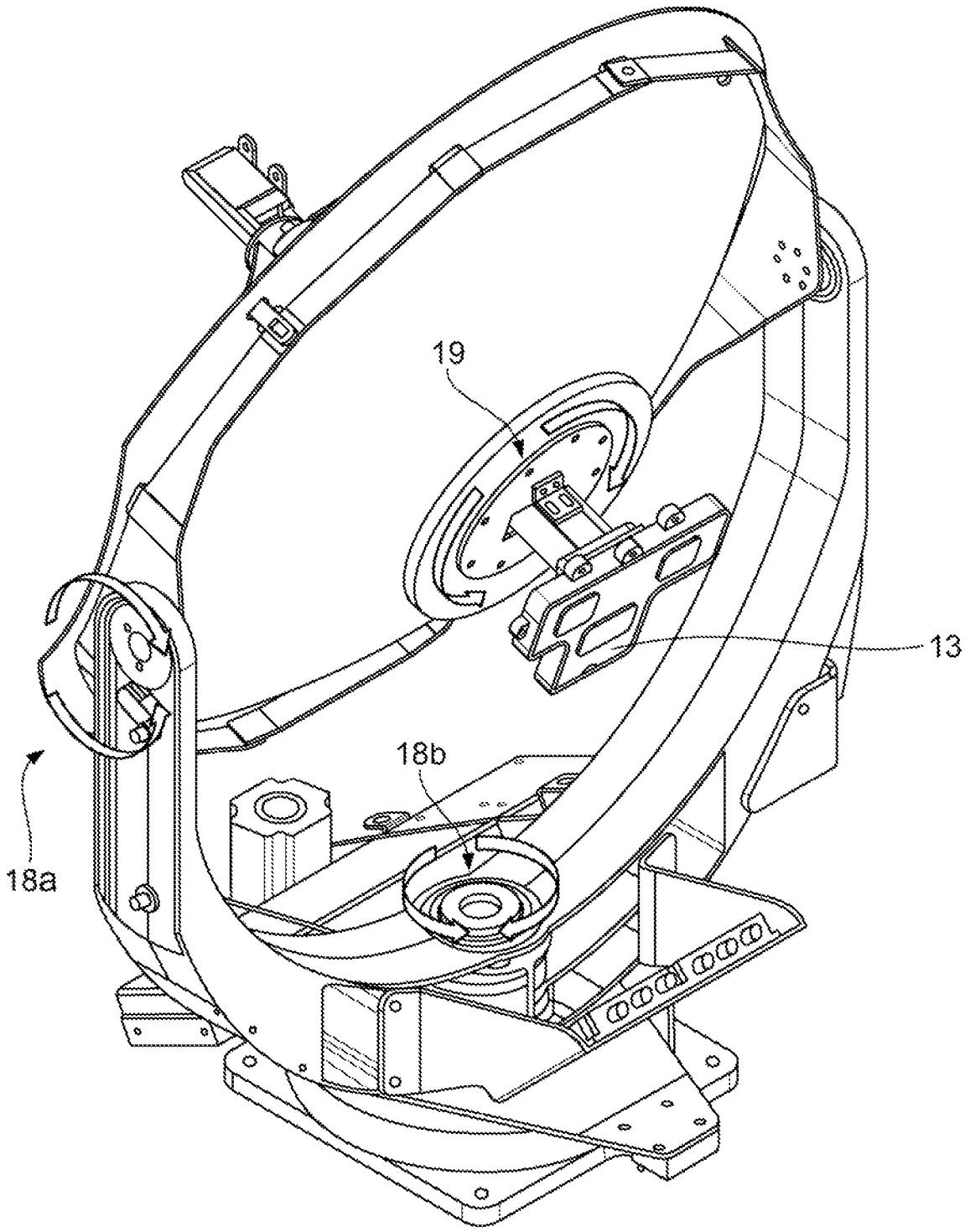

FIG. 1A illustrates a schematic view of an antenna system 10 installed on a roof of a moving platform (not shown) configured to receive and transmit at least three separate RF signals in accordance with an embodiment of the present invention. FIGS. 1B, 1C and 1D illustrate a front, top and rear view of the antenna 10 as configured in accordance with a preferred embodiment. The antenna system 10 is preferably an axially symmetrical reflector system. The system 10 includes a primary reflector II about 24 inches in diameter, having at least one opening 11*a*. The reflector shown in the present embodiment is a parabola-shaped reflector and is preferably made of metals such as aluminum or steel. The reflector 11 is not limited to metals and may also be made of other materials such as carbon fiber. The system further includes a feed horn assembly 12 having at least two feed tubes/horns 12*a* and 12*b* extending from the front to the rear of the primary reflector 11 via the opening 11*a*. It is noted that only one opening is preferably required to accommodate the dual Ka-band feed horn assembly 12 since only this assembly 12 must rotate about the parabola axis to align the two Ka-band antenna beams with the satellites as will be described in greater detail below. However, one skilled in the art would appreciate that the reflector 11 may have two openings (i.e. a separate opening for each feed horns 12*a* and 12*b*) in which case the entire antenna system 10 would need to rotate about the central axis of the parabola in order to track the three antennas simultaneously. In an even further embodiment, no opening and no assembly 12 may be required and simply a cable is preferably routed around the front of the reflector 11 to pass the signal through the reflector 11.

Feed horns 12*a* and 12*b* are preferably made of metals such as aluminum or steel, although they may also be metal coated plastic. Feed horns 12*a* and 12*b* are preferably connected to the primary reflector 11 preferably via injection molding. These feed horns are closely spaced and arranged in a substantially linear array along a linear axis to preferably receive Ka band signals as will be described in greater detail below. The feed horns 12*a* and 12*b* may vary in shape and size. As illustrated in FIG. 1A, the primary reflector 11 is coaxially disposed about the feed horns 12*a* and 12*b*. A low-noise block (LNB) converter 13*a*, preferably a Ka Band LNB is affixed to one end of the feed horn 12*a* at the rear of the primary reflector as shown. Similarly, a LNB converter 13*b*, preferably a Ka Band LNB is affixed to one end of the feed horn 12*b* at the rear of the primary reflector 11.

The system 10 further includes at least a sub-reflector 14 about 6.5 inches in diameter, disposed to face towards the front of the primary reflector 11. Specifically, the front surface of the sub-reflector 14 includes a reflecting surface facing the front surface of the primary reflector 11. In order for the sub-reflector 14 to be in-plane and concentric with the primary reflector 11, specific range of distance and/or angle are chosen such that the sub-reflector 14 images the satellite beam reflected from the surface of the primary reflector 11 onto the end of the feed horn assembly 12. This range of distance and/or angle preferably depends on the shape and the size of both the primary and the sub-reflector. In this embodiment, the sub-reflector 14 is an approximate hyperbolic shape, but relatively small compared to the primary reflector 11. The sub-reflector 14 shares the same axis as the primary reflector 11 and the feed horns 12*a* and 12*b*. As a result, the sub-reflector 14 is positioned to receive and transmit communication signals between the feed horns 12*a* and 12*b* and the primary reflector 11. A feed horn 15 is affixed to rear of the sub-reflector 14 as shown in FIG. 1A. The feed horn 15 preferably functions to receive Ku band signals as will be described in greater detail below. As shown in FIG. 1A, an LNB 16, preferably a Ku band LNB is affixed to the rear of the feed horn 15. The primary reflector 11 is secured to the sub-reflector 14 preferably via support brackets 17 extending between the primary reflector 11 and the Ku band LNB 16 as shown.

The Ka-band feed horn assembly 12 of the present invention is a dual mode horn design to provide symmetrical radiation patterns at Ka-band while maintaining a compact outer diameter. This pattern symmetry provides higher efficiency and improved off axis performance. The dual mode horns 12*a* and 12*b* incorporate a smooth outer wall and use the combination of two modes, the dominate Transverse Electric mode ($TE_{11}$) and one higher order mode, the Transverse Magnetic mode ($TM_{11}$), to provide a radiation pattern similar to a larger outer diameter corrugated horn counterpart. The detailed operation of these horns is described in U.S. Pat. Nos. 3,305,870 and 4,122,446. The diameter of each of the feed horns 12*a* and 12*b* of the present invention is preferably in the range of about 0.9 inches to about 1.0 inches. One of the advantages of using these smaller diameter horns is that two of these horns 12*a* and 12*b* can preferably be placed side by side (approximately 0.45" to 0.50" apart) with the correct linear offset from the center of the main reflector axis to provide the +1-2 degree angular offsets from the center Ku-band beam.

Figure 1E:
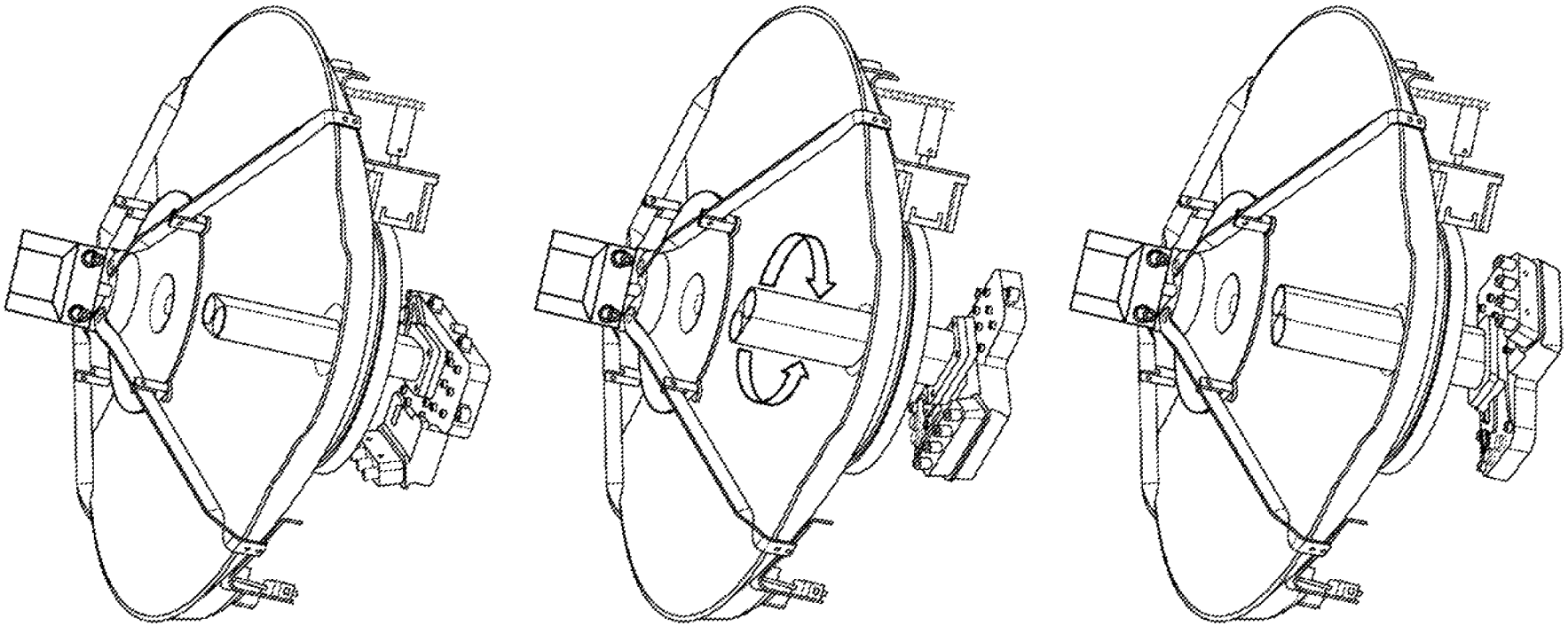
FIG. 1E illustrate various front view rotations of the antenna of FIG. 1A in accordance with a preferred embodiment of the present invention.
Figure 1F:
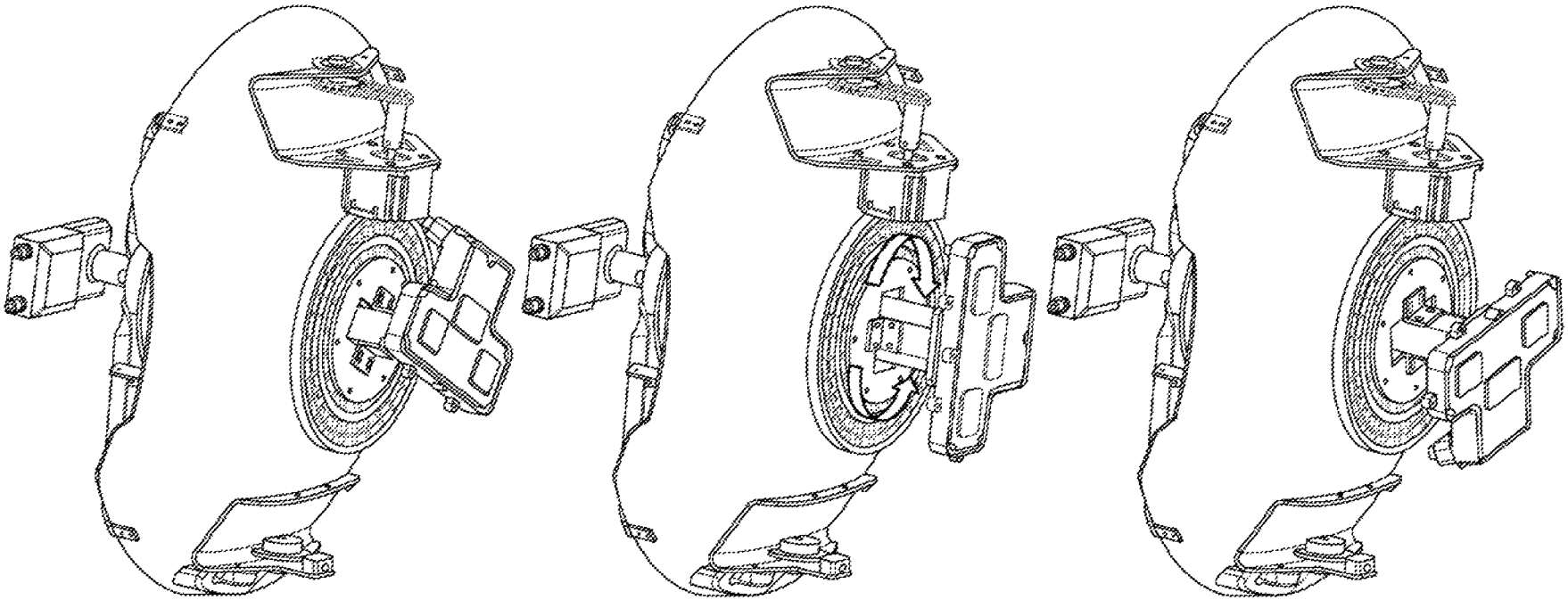
FIG. 1F illustrate various rear view rotations of the antenna of FIG. 1A in accordance with a preferred embodiment of the present invention.

Referring to FIGS. 1B, 1C and 1D, there is shown a front, top and back view respectively of the antenna system 10. The system 10 also includes an azimuth and elevation adjustment assembly 18*a* and 18*b* respectively, which are motor driven mechanisms used generally for single beam antenna. Additional details of these mechanisms for a single beam antenna are provided in the U.S. Pat. No. 5,835,057, which is hereby incorporated by reference. However, in the present invention, the antenna system 10 is tracking beams from at least three different satellites (not shown) at various angles. Thus, a third axis of mechanical motion is required to simultaneously align the three antenna beams with the geostationary orbital arc, despite the relative motion of the moving platform. This third axis of mechanical motion is provided by a skew adjustment 19 which is also a motor driven mechanism placed behind the primary reflector 11 encompassing a portion of the dual feed horn 12*a* and 12*b* as shown in FIG. 1D. This skew adjustment 19 functions to rotate the dual feed horn 12*a* and 12*b* about the center axis of the primary reflector 11 to align with the orbital arc in order to track the two Ka band beams from two different satellites (not shown) at different angles. FIGS. 1E and 1F illustrate front and back view of various rotations of the feed horns 12 and 12*b*. As illustrated in FIGS. 1E and 1F, this satellite-antenna system 10 will simultaneously adjust the azimuth and elevation of the complete Ka/Ku/Ka multi-beam antenna and rotation angle of the Ka-band dual feed horn assembly 12 to keep all the three beams simultaneously pointed towards the desired satellites.

It is noted that the above described embodiments of the present invention can be used in conjunction with the mounting arrangement of the antenna assembly on a moving platform as disclosed in commonly owned issued U.S. Pat. No. 7,443,355, which is hereby incorporated by reference.

In a preferred embodiment of the present invention, the sub-reflector 14 is a frequency selective surface (FSS) sub-reflector. Frequency selective surfaces have been known in the art. Briefly, the FSS consists of a sheet of dielectric material arranged with a closely spaced array of resonant elements. In the preferred embodiment of the present invention, the FSS is designed using a single layer of dielectric with thin layers of patterned metal coating on both sides. Periodic shapes are etched into the metal layers on both sides on the dielectric having geometry preferably of a four legged loaded loop type element. Alternatively, the FSS may be designed using multiple layers of dielectrics being added to the outside of the patterned metal layers for the purpose of impedance matching the FSS to free space propagation. In this later case, the FSS stack up includes five layers, dielectric, metal, dielectric, metal, and dielectric layer. The sub-reflector 14 is constructed preferably with either Teflon or HPDE dielectric and is approximately 0.125" thick.

The resonant elements are sized and configured to resonate at the frequencies to be reflected by the FSS. The FSS remains largely transparent to other frequencies. The FSS sub-reflector is designed to reflect the Ka-band signal and to simultaneously allow Ku-band signal transmission with minimal loss. In particular, the FSS sub-reflector 14 is designed and configured to be substantially transparent to radio frequency in the range of 10 to 15 GHz in the Ku band while substantially reflecting higher radio frequency in the range of 18 GHz to 30 GHz in the Ka-band. More details of the FSS structure is disclosed on U.S. Pat. Nos. 6,208,316 and 5,949,387.

Figure 2A:
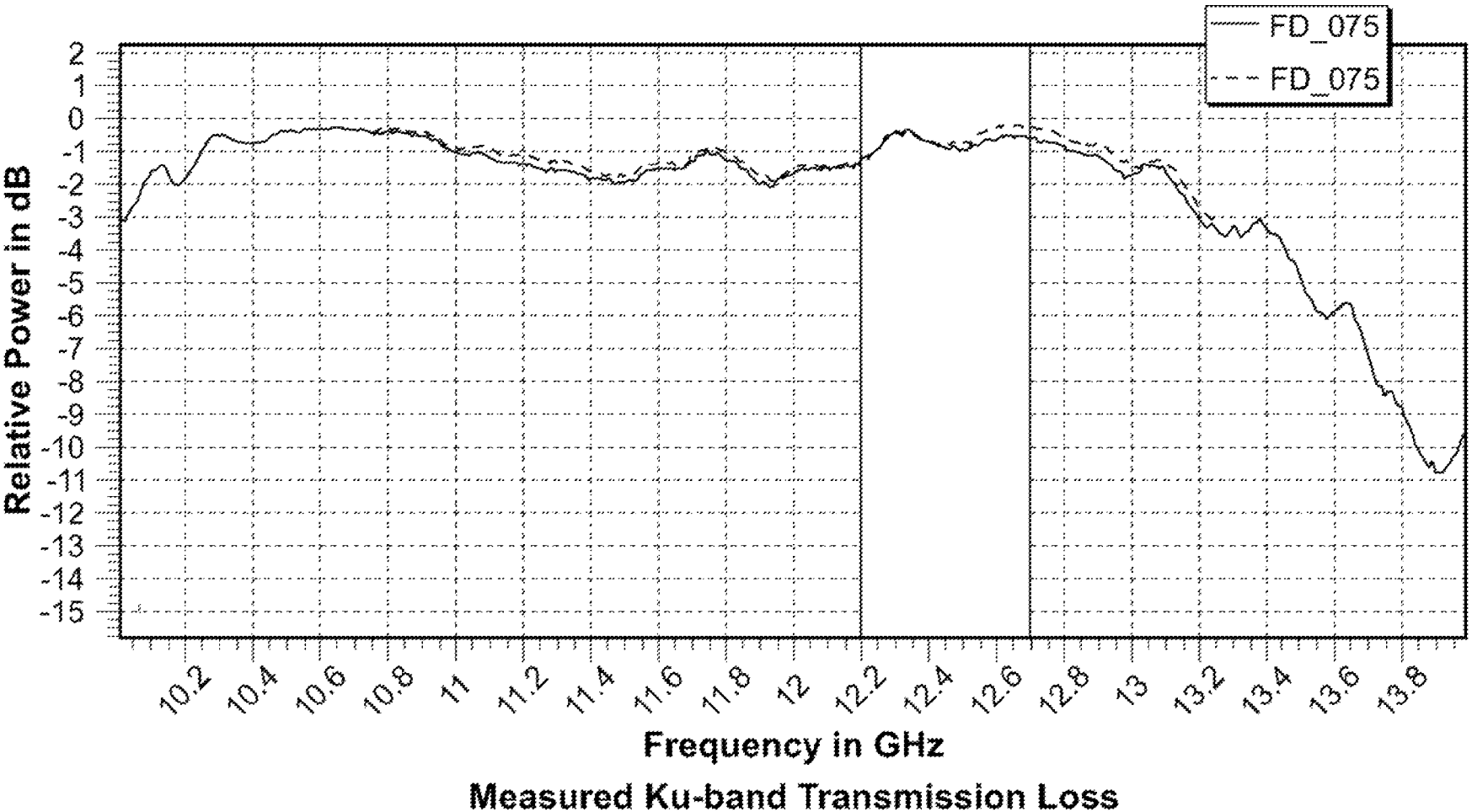
FIG. 2A illustrate a graphical representation of the measurements of Ku-band transmission loss.
Figure 2B:
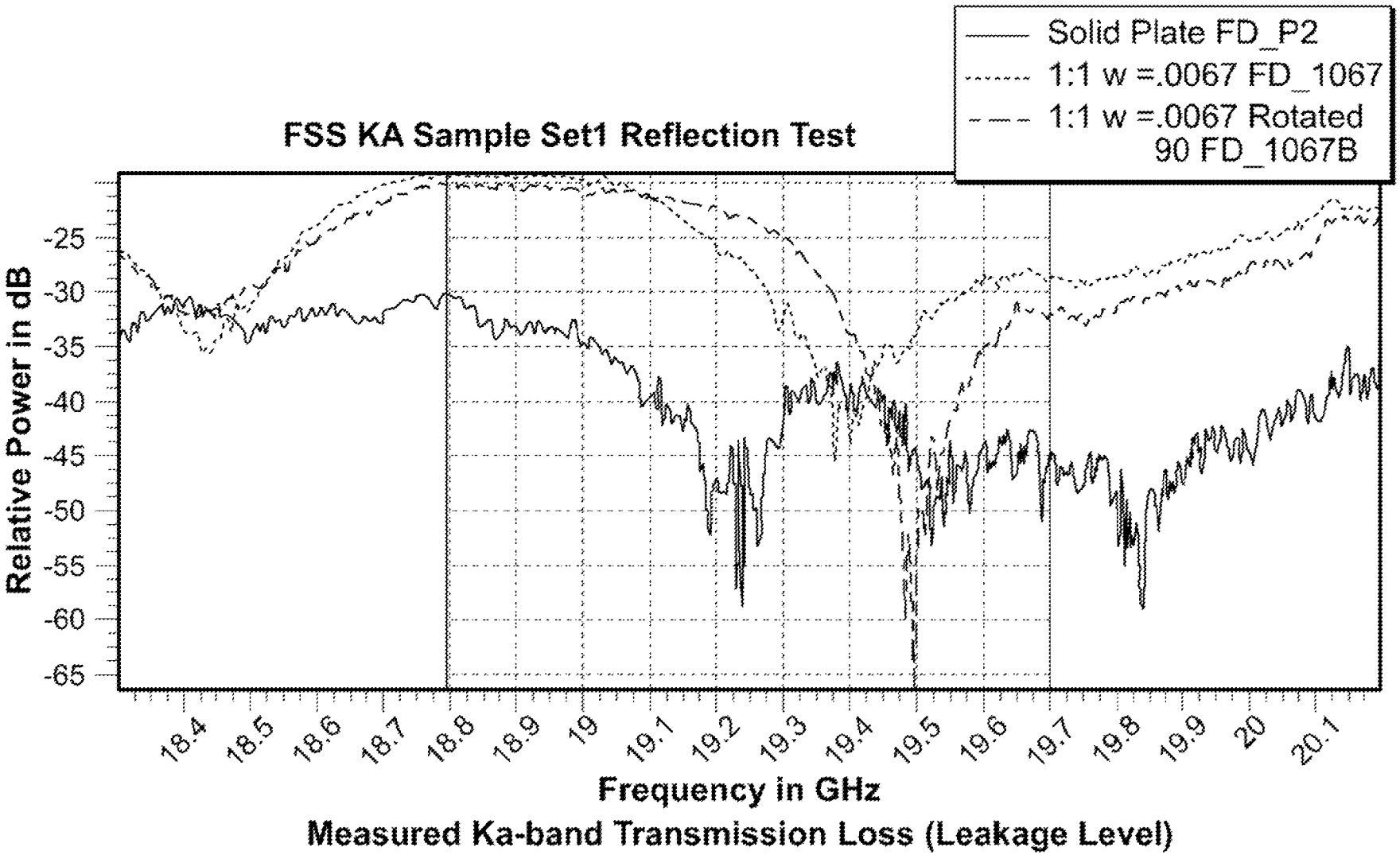
FIG. 2B illustrate a graphical representation of the measurements of Ka-band transmission loss.

In the present invention, the FSS panels for the sub-reflector were evaluated by measuring the transmission characteristics across the Ku and Ka bands. FIGS. 2A and 2B show graphical representations of the measurements of Ku-band transmission loss and Ka-band transmission loss (leakage level) respectively. As illustrated in FIG. 2A, the best panel resulted in about 0.7 dB transmission loss at Ku-band, 12.2-12.7 GHz. The panels responded correctly at Ka-band, 18.3-18.8 GHz and 19.7-20.2 GHz as shown in FIG. 2B. The FSS panels exhibited at least about 20-30 dB transmission leakage at Ka-band. A transmission leakage of about 20 dB implies only 1/100 of the power transmitted through the panels, and, ignoring absorption, 99/100 is reflected. The corresponding reflection loss at Ka-band is very low, i.e. about 0.04 dB.

More particularly, a first satellite (not shown) located preferably at 101 degrees west longitude delivers a beam 40 in a Ku frequency band preferably in the range of 11 GHz to 13 GHz to the primary reflector 11. The active surface of the primary reflector 11 reflects this beam signal 40 to the FSS sub-reflector 14. Thus, the frequency of the beam 40 enables the beam signal to pass through the FSS sub-reflector 14 directly into the feed horn 15. Substantially this entire RF signal 40 is reflected from the primary reflector 11 onto the FSS sub-reflector 14. Since, the Ku component of the RF energy reflected from the surface of the reflector 11 is in the 11-13 GHz range, the beam signal 40 passes directly through the sub-reflector 14 with substantially no loss and is focused (by the reflector 11) upon the Ku feed horn 15. This beam signal 40 is then received by Ku band LNB 16, which amplifies and down converts to a lower frequency band. This result in the Ku band LNB 16 to operate in a prime focus mode.

A second satellite (not shown) positioned preferably at 99 degrees west longitude delivers a beam 42 in a Ka frequency band of 18 GHz to 20 GHz. The active surface of the primary reflector 11 reflects this beam signal 42 to the FSS sub-reflector 14. As such, the material of the FSS is selected to reflect this frequency range. The surface of the FSS sub-reflector 14 reflects the beam 42 directly into the feed horn 12*a*. Since the Ka component of the RF energy reflected from the surface of the reflector 11 is in the 18-20 GHz range, the beam signal 42 is substantially reflected by the sub-reflector 14. The shape of the sub-reflector focuses the reflected Ka component upon the Ka feed horn 12*a*. The feed horn 12*a* in turn guides the signal to the LNB converter 13*a*, which amplifies and down converts to a lower frequency band.

A third satellite (not shown) located preferably at 103 degrees west longitude delivers a beam 44 similar to the beam 42 such that it also contains Ka frequency of 18 GHz to 20 GHz. The active surface of the primary reflector 11 reflects this beam signal 44 to the FSS sub-reflector 14. As such, the material of the FSS is selected to reflect this frequency range. As discussed above with respect to the beam signal 42, the surface of the FSS sub-reflector 14 also reflects the beam 44 directly into the feed horn 12*b*. The feed horn 12*b* in turn guides the signal to the LNB converter 13*b*, which amplifies and down converts to a lower frequency band.

Thus, the LNBs 13*a*, 13*b* convert the Ka band frequency down to L Band frequency and the LNB 15 converts the Ku band frequency down to the L Band frequency. Preferably, the Ka LNBs 13*a* and 13*b* convert down to 250-750 MHz and 1650-2150 MHz and the Ku LNB 16 converts down to 950-1450 MHz. In a preferred embodiment, these L Band signals can be fed into a splitter/combiner (not shown) which will pass the combined or stacked signal to a receiver (not shown). The receiver in turn unstacks the L Band signal so that the user can watch digital video broadcasts.

As discussed above, the shape and the position of the reflector 11, sub-reflector 14 and feed horns 12*a* and 12*b* are mechanically determined to provide a focus of the second satellite Ka 99 degrees west longitude beam directly onto the feed horn 12*a* and of the third satellite Ka 103 degrees west longitude beam onto the feed horn 12*b*. While the vehicle is in motion, a satellite tracking system, such as disclosed in commonly owned issued U.S. Pat. No. 5,835,057 can be employed to maintain focus such that all the signals go directly into their respective feed horns.

Figure 3A:
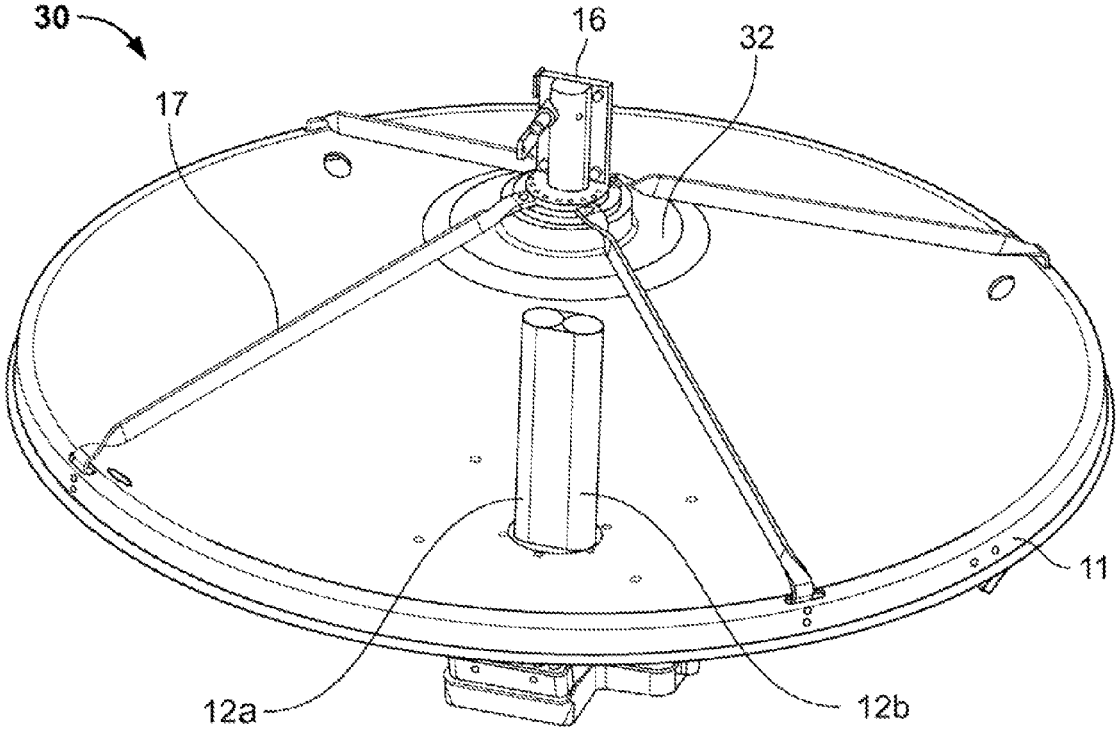
FIGS. 3A and 3B illustrate a top and a bottom view respectively of the antenna in accordance with an alternate embodiment of the present invention
Figure 3B:
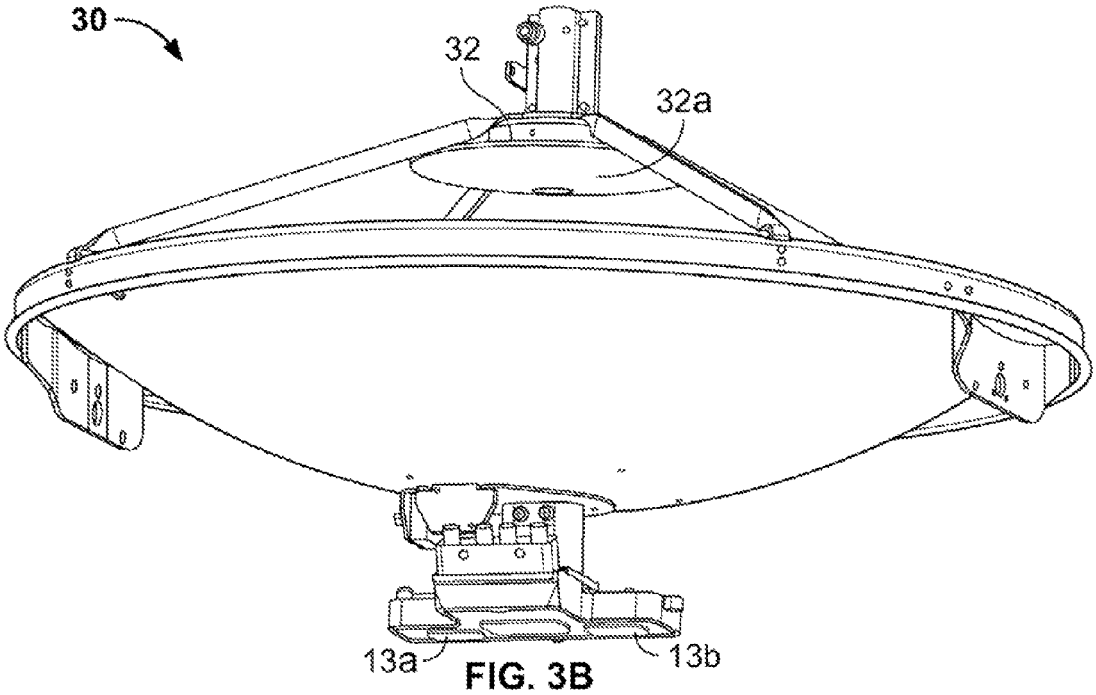

Referring to FIGS. 3A and 3B, there are shown top and bottom views respectively of the antenna 30 as configured in accordance with an alternate embodiment of the present invention. Antenna 30 is similar to antenna 10 except the FSS sub-reflector 14 is replaced with a sub-reflector 32 facing the front of the primary reflector 11. This sub-reflector 32 also includes a reflecting surface but is devoid of FSS. It includes an opening 32*a* preferably in the center as shown in FIG. 2B. In this embodiment, the Ka frequency beams 42 and 44 are reflected by the sub-reflector 32 directly into the feed horns 12*a* and 12*b* respectively of the primary reflector 11 as described above. However, the Ku frequency beam 40 reflected from the primary reflector 11 is passed through the opening 32*a* of the sub-reflector 32 directly into the Ku band LNB 16. In the preferred embodiment, a feed horn (not shown) is integrally attached to the LNB 16, thus providing a direct access to the Ku feed horn for reflected Ku band RF signals.

It is noted that the antenna system of the present invention has been described with frequency signals in the Ka and Ku band signals, however, it known to one skilled in the art that these signals can be replaced with other high frequency RF band signals such as C band signals in the range of 4-8 GHz and/or X band signals in the range of 8-12 GHz and many others.

While the present invention has been described with respect to what are some embodiments of the invention, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

The invention claimed is:

1. A mobile antenna system in communication with multiple satellites for use in a moving platform, said system comprising:

a primary reflector shaped and positioned to receive and reflect at least one Ku band signal and at least two Ka band signals of different angles at a focal region located on the primary reflector, said primary reflector having at least one opening for accommodating at least two feed horns to receive said at least two Ka band signals;

a sub-reflector shaped and positioned to face the focal region of the primary reflector to reflect the at least two Ka band signals that the primary reflector directed to the focal region and to receive at least one Ku signal reflected by the primary reflector; and a first motor driven mechanism positioned around said feed horns to rotate said two feed horns about a center axis of the primary reflector.

2. The system of claim 1 wherein said primary reflector is secured to said sub-reflector via a mechanical bracket.

3. The system of claim 1 wherein diameter of each of said Ka-band feed horns is in the range of 0.9 inches to 1.0 inches.

4. The system of claim 1 wherein one of said Ka-band feed horns is placed in close proximity to a second of said Ka-band feed horn.

5. The system of claim 1 further comprising at least one low noise block converter affixed to each of at least two feed horns for converting frequency of the Ka band signal to L band frequency.

6. The system of claim 1 wherein said sub-reflector has a frequency selective surface.

7. The system of claim 1 wherein said Ka band feed horns are disposed at the rear of the primary reflector.

8. The system of claim 1 wherein said sub-reflector has an opening to accommodate at least one Ku feed horn for receiving said Ku signal.

9. The system of claim 8 wherein said Ku feed horn is disposed at the rear of the sub-reflector.

10. The system of claim 7 further comprising at least one low noise block converter affixed to the Ku feed horn for converting frequency of the Ku band signal to L band frequency.

11. The system of claim 1 wherein said sub-reflector has a reflecting surface with an opening to directly receive the Ku band signal.

12. The system of claim 11 further comprising at least one low noise block converter integrally attached to rear of the sub-reflector to receive said Ku band signal via said opening.

13. The system of claim 1 wherein said rotation of the two feed horn aligns the feed horn assembly with an orbital arc to track the at least two Ka band signals.

14. The system of claim 13 further comprising a second and third motor driven mechanism to position the primary reflector and mounted components in both azimuth and elevation to track at least one Ku band signal.

15. The system of claim 14 wherein said first motor driven mechanism is positioned and controlled simultaneously with said second and third motor driven mechanisms in order to simultaneously track the two Ka band and the Ku band signals.

* * * * *